US005913782A

United States Patent [19]

Monaco et al.

[11] Patent Number: 5,913,782

[45] Date of Patent: Jun. 22, 1999

[54] KNOCKDOWN ROOF PLATFORM FOR USE ON AN INCLINED ROOF

[75] Inventors: Gary J. Monaco, 4 Winding Branch Rd., Hawthorn Woods, Ill. 60047; Glenn R. Gricus, Bloomingdale, Ill.

[73] Assignee: Gary J. Monaco, Hawthorn Woods, Ill.

[21] Appl. No.: 09/002,467

[22] Filed: Jan. 2, 1998

[51] Int. Cl.[6] ..... E04D 15/07

[52] U.S. Cl. ..... 52/126.1; 52/749; 182/45; 248/148

[58] Field of Search ..... 52/126.1, 749; 182/45; 248/148, 237; 108/64

[56] References Cited

U.S. PATENT DOCUMENTS 5,249,397 10/1993 Monaco ..... 52/126.1

*Primary Examiner*—Creighton Smith
*Attorney, Agent, or Firm*—Meroni & Meroni

[57] ABSTRACT

A knockdown platform for use on an inclined surface comprising a table structure having an upper table top with a plurality of indentations and openings for containment of a variety of objects. The table structure has a hollowed area on its underside. An upright leg structure is positioned at one end of the table structure. A hinge connects the table structure and the upright leg structure in assembly together in the hollowed area. Collapsible locking brackets further secure the table structure and the upright leg structure in assembly. The collapsible locking brackets are adjustable so as to secure the table structure and the upright leg structure at right angles. The collapsible locking bracket is releasable enabling the table structure and the upright leg structure to be pivoted on the hinge located interior to the hollowed area on the underside of the table structure. The collapsible locking bracket allows for the collapsing of the table structure and the upright leg structure out of right angle relation relative to one another and into a collapsed storage position where the table structure and the upright leg structure extend generally in a parallel relation.

9 Claims, 2 Drawing Sheets

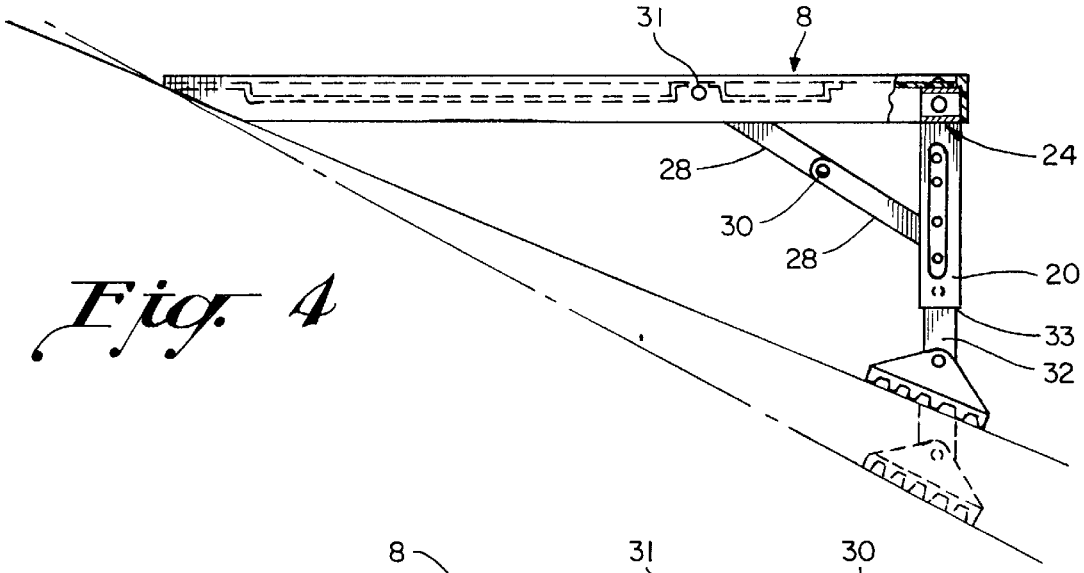
Fig. 4
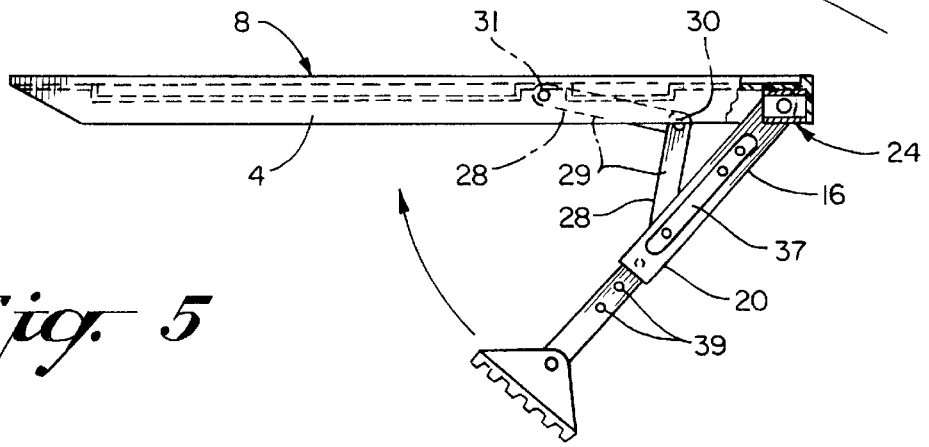
Fig. 5
Fig. 6
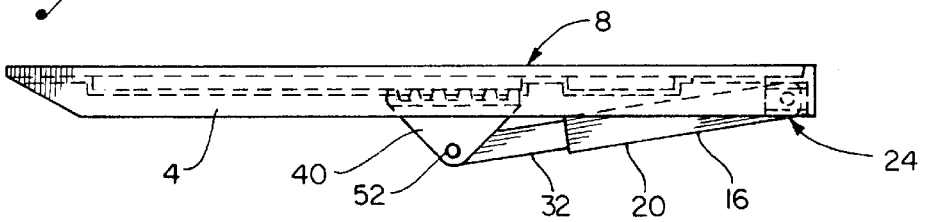
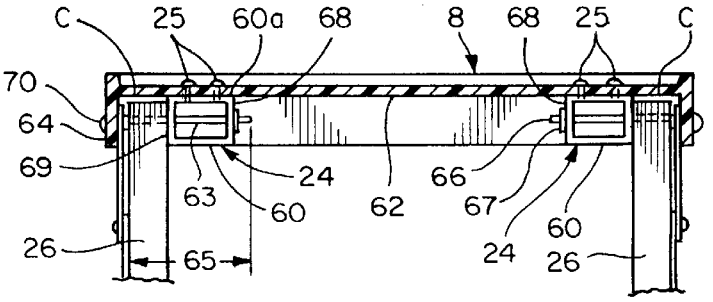
Fig. 7

KNOCKDOWN ROOF PLATFORM FOR USE ON AN INCLINED ROOF

BACKGROUND OF THE INVENTION

1. Field of the Invention

The field of art to which the invention pertains is related to new and improved reinforced knockdown platforms of the type used on an inclined roof so as to provide accessibility to a worker on the roof to painting, roofing materials, or the like which may be used or possibly used by the worker.

2. Description of the Related Art

U.S. Pat. No. 5,249,397 shows one type of collapsible roof platform. The platform of U.S. Pat No. '397 is provided with its upright leg structure located exterior to and congruent with the flat table top surface.

The present invention overcomes the limitations of the prior art by providing a platform with an upright leg structure located on the interior of the hollowed underside of the table so as to prevent catching or snagging of objects on the upright leg structure as positioned when exterior to the table top.

The present invention further relates to a new and improved hinging arrangement which hinges a collapsible upright leg structure to a platform in a cost savings way.

SUMMARY OF THE INVENTION

A knockdown platform for use on an inclined surface comprising a table structure having an upper table top with a plurality of indentations and openings for containment of a variety of objects. The table structure has a hollowed area on its underside. An upright leg structure is positioned at one end of the table structure and is comprised of a plurality of individual downwardly extending hollowed leg sections. A hinge connects the table structure and the upper leg structure in assembly together. Collapsible locking brackets further secure the table structure and the upright leg structure in assembly. The collapsible locking brackets are adjustable so as to secure the table structure and the upright leg structure at right angles. The collapsible locking brackets enable the table structure and the upright leg structure to be pivoted on the hinge located interior to the hollowed area on the underside of the table top. The collapsible locking bracket allows for the collapsing of the table structure and the upright leg structure out of right angle relation relative to one another and into a collapsed storage position where the table structure and the upright leg structure extend generally in a parallel relation.

According to other features of the invention, the upright leg structure comprises a plurality of individual downwardly extending hollowed leg structures which are capable of being collapsed and extended independently of each other. Each forms a sleeve for engagement with an adjustable hollowed lower leg section insertable into the sleeve of each downwardly extending leg structure. An attachment means joins the downwardly extending leg sections in adjustable attachment to the lower leg sections in telescoped adjustable assembly. In one embodiment, the attachment means comprises alignable holes in the downwardly extending leg sections and the upwardly extending leg sections wherein an adjustable and movable pin is inserted through the alignable holes. Once the adjustable and movable pin is inserted in the alignable holes, the downwardly extending legs and the upwardly extending legs are maintained in variable attachment.

According to other features, we have provided a knockdown platform for use on an inclined surface comprising: a table structure having indented areas for holding tools. A plurality of first and second or upper and lower surfaces form the table structure. A hollowed area is defined by a second surface opposite the first surface on an underside of the table top defining spaced apart corners. Extendible multi-sectioned upright legs structures are provided. Means for securing legs section in adjusted position relative to one another on each of said extendible multi-sectioned upright leg structures is provided. An upper surface of each of the upright leg structures is fixedly connected to the table top at only one end of the table structure remote from said indented areas but adjacent to said corners. The upper surface of the upright leg structure is positioned in the hollowed area on the underside of the table top and the upright leg structure is positioned in right angular relation to the table structure. A plurality of downwardly extend leg sections extending from the upright leg structure. A pair of hinge mechanisms are positioned in spaced apart relation on the hollowed underside of the table structure at the corners connecting the table structure and the upright legs structure in unitary assembly together. A plurality of collapsible locking bracket mechanisms secure the table structure and the upright leg structures in assembly together. Each of the collapsible locking bracket mechanisms are adjustable to secure the table structure and the upright leg structure in right angular relation when in the upright position. The collapsible locking bracket mechanism are releasable to enable the table structure and the upright leg structure to be pivoted on an associated one of the hinge mechanisms into a storage position in the hollowed underside of the table structure where the upright leg structure is in almost parallel relation to the table structure thus enabling movement of the table structure out of right angular relation into a collapsed position.

Yet other objects and features of the invention will become apparent in view of the following detailed description of the invention taken in conjunction with the accompanying drawings illustrating an embodiment which is also hereinafter described.

BRIEF DESCRIPTION OF THE DRAWINGS

FIG. 4 is a side view of the knockdown platform shown in full and dotted lines on an inclined surface and showing the adjustability of the feet.

FIG. 5 is an enlarged view of the knockdown platform showing the manner in which the platform can be collapsed for storage.

FIG. 6 is a side view of the knockdown platform in a storage position.

FIG. 7 is an enlarged view of the underside of the knockdown platform showing the new and improved manner in which the hinge connects the table top and the upright leg structure.

DESCRIPTION OF THE PREFERRED EMBODIMENT

Figure 1:
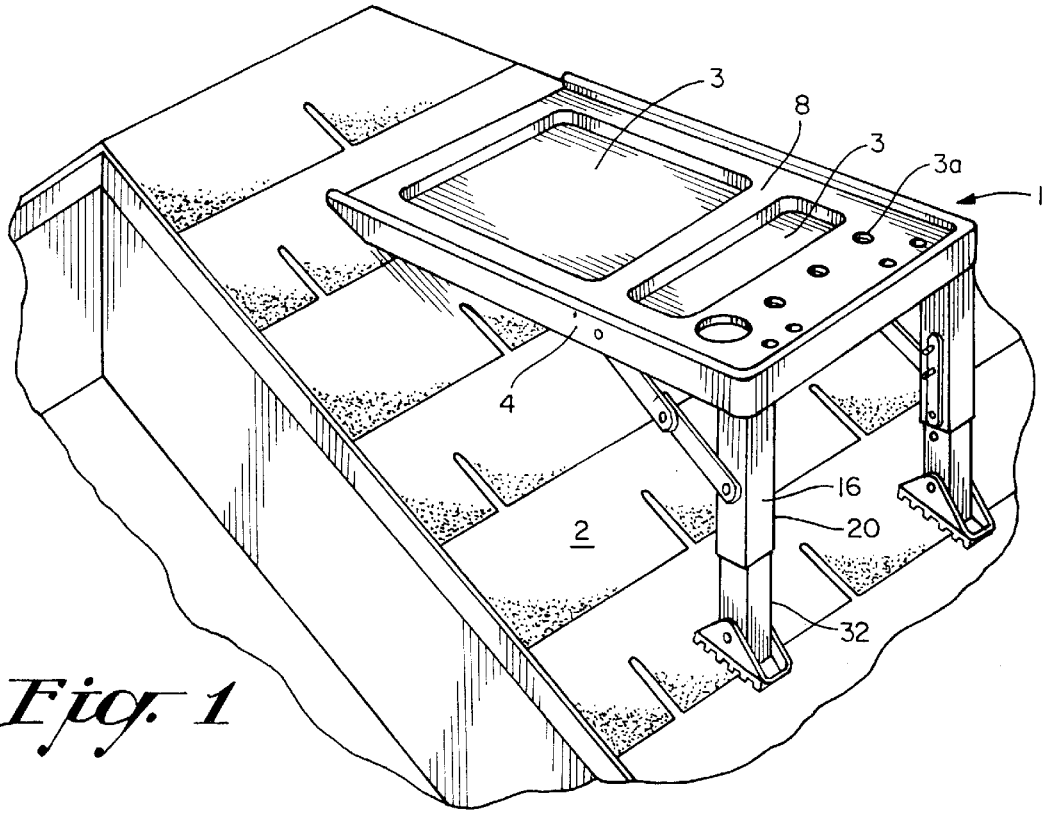
FIG. 1 is an enlarged perspective view of the knockdown platform showing various openings and indentations in the table top and shown on an inclined roof of a building.
Figure 2:
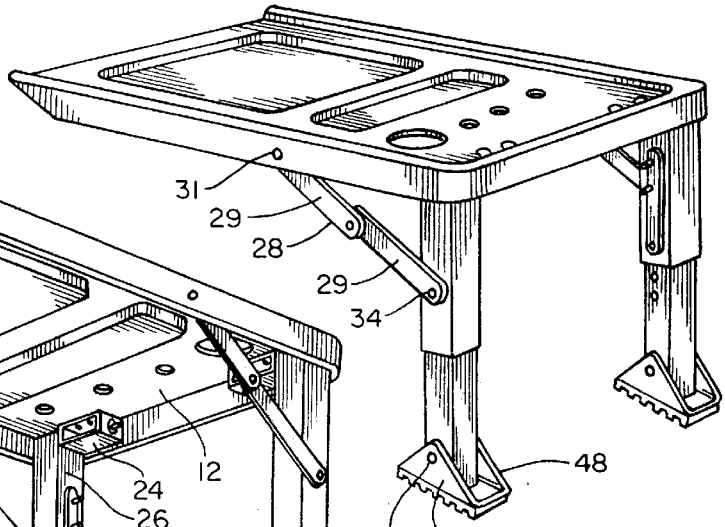
FIG. 2 is an enlarged perspective view of the platform shown in FIG. 1 standing free of the roof.

Reference numeral 1 indicates generally the new and improved knockdown platform. The platform I is adapted for mounted disposition upon an inclined surface such as a roof 2 as shown in FIG. 1. The platform 1 is particularly adapted to enable a worker on the inclined surface 2 to perform a variety of tasks and to carry a variety of objects. All of the variety of objects are carried on the knockdown platform 1, and more particularly, on the upper table top 8. According to features of my invention, the upper table top 8 of the platform 1 is provided with a plurality of various sized indentations 3 and openings to secure various sized and shaped objects. In one embodiment, a screw driver can be secured by insertion into one of the plurality of holes located in the upper table top 8 or a paint can be secured by being placed within one of the indentations in the surface of the table top 8 of the platform 1. In one embodiment, the upper table top 8 is comprised of a suitable lightweight synthetic plastic material or other suitable material and is of a uniform thickness. The knockdown platform 1 has a hollowed area 12 having corners C, C on the underside of the table top 8.

Figure 3:
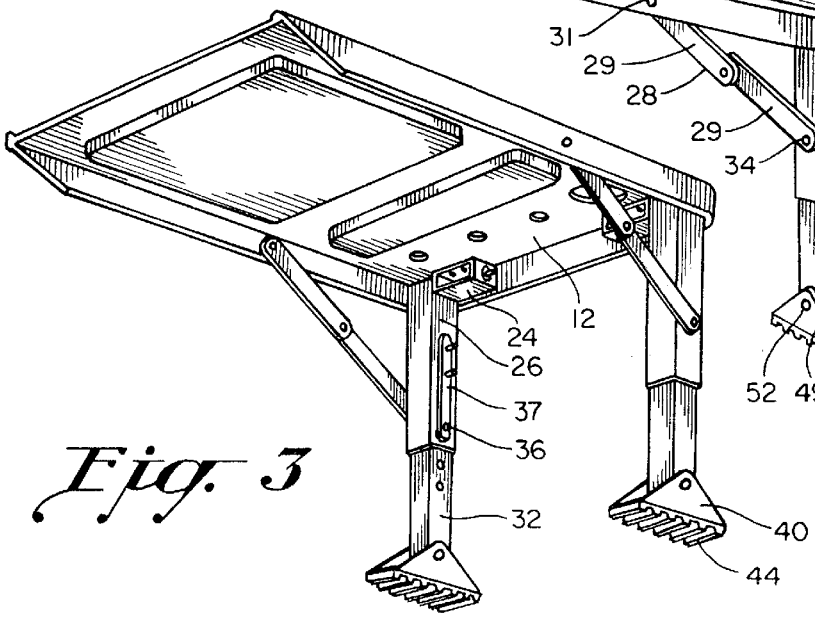
FIG. 3 is an enlarged perspective view of the knockdown platform shown in FIG. 2 as viewed from an underside position.

In one embodiment, aluminum extendible multi-sectioned upright leg structures 16 are provided at one end of the upper table top 8. Each of the leg structures are identical in function and a description of one will suffice for both of them. The upright leg structure 16 assists in maintaining and supporting the upper table top 8 in a horizontal plane with respect to the inclined surface 2. A hinge device or mechanism 24 is secured by rivets or suitable fasteners 25 adjacent to one comer C of the hollowed area 12 on an underside of the upper table top 8 and to an inner wall 26 of the upright leg structure as shown in FIG. 3. In one embodiment, the hinge device 24 is riveted to the table structure 4. A pair of the mechanisms are provided at the corners C, C. Also provided for securing the table structure 4 and the upright leg structure 16 are a pair of collapsible leg locking brackets 28,28 for locking the legs in an upright position relative to the table structure 4 as seen in FIGS. 1–4.

The upright leg structure 16 is comprised of a plurality of downwardly extending hollow leg sections 20 attached to the table structure 4 at one end by a plurality of hinges 24. Each of the downwardly extending hollowed leg sections 20 posses a leg opening, in one embodiment comprised of parallel sided square-shaped leg openings, indicated in FIGS. 1–4 at 33.

The upright leg structure 16 further includes a plurality of hollow telescopingly mounted lower leg sections 32. The lower leg sections 32 are of the same external configuration as the openings 33 and hollowed interior of the downwardly extending leg sections 20. In one embodiment, the lower leg sections 32 are of a square-shaped external peripheral configuration of slightly smaller size than the leg openings 33 so that the lower leg sections 32 can be inserted into the leg openings 33, and covered by the sleeve-like downwardly extending hollow leg sections 20, as seen in FIGS. 1–6. In one embodiment, the downwardly extending 20 and the lower leg 32 sections as composed of aluminum or other suitable material.

In one embodiment, the downwardly extending hollow leg sections 20 are telescopingly attached to the hollow lower leg sections 32 through the use of a plurality of attachment pins 36. Each attachment pin 36 has an attachment flange 37 for mounting on each respective downwardly extending leg section 20. In one embodiment, the attachment pins 36 are riveted at the attachment flanges 37 to the downwardly extending leg sections 20. In one embodiment, a thumb hook 38 is provided at the attachment pin 36. By pulling on the thumb hook 38, the attachment pin 36 is disengaged from the plurality of pin holes 39 located in alignable positions in the downwardly extending leg sections 20 and the lower leg sections 32.

The pin holes 39 are provided in the downwardly extending hollow leg sections 20 and on opposite sides of each of the lower leg sections 32. The pin holes are arranged in aligned pairs on the lower leg sections 32. The attachment pins 36 extend through a matched pair of the pin holes 39 on opposite sides of the lower leg sections 32 and through a pin hole 39 provided on the downwardly extending leg sections 20 which is aligned with the hole 39 in the lower leg section 32.

The knockdown platform 1 also includes identical feet 40, 40 on each lower leg section 32. In one embodiment, the feet 40, 40 are of a sheet metal construction and can be made from aluminum, steel or other suitable material. The feet are provided with pads 44,44, in one embodiment of rubber, to provide traction. The rubber pads 44,44 are attached to the feet 40,40 by glue or other suitable attachment means. Each of the feet 40,40 has a pair of upright foot flanges 48,49 which are spaced apart and adapted to engage on opposite sides of the lower leg sections 32. Foot attachment pins 52 extend through the upright foot flanges 48,49 as well as through the associated lower leg sections 32. In one embodiment, the foot attachment pins 52 can be secured by rivets or other suitable attachment means. It is necessary that the feet 40,40 be readily adjustable with respect to the lower leg sections 32 so that the feet 40,40 are readily positionable at different angles of inclination depending on the pitch of the inclined surface 2. The ability of the lower leg sections 32 and the feet 40,40 to be readily adjustable as shown is FIG. 4.

In use, the upright leg structure 16 is positioned in abutting relationship and at right angles with respect to the table structure 4. The top of the upright leg structure 16 is positioned parallel with the hollowed area 12 on the underside of the table top as shown in FIGS. 3 and 4. The upright leg structure 16 is pivotable on the hinge 24 so as to bring the upright leg structure 16 to a fully extended position at right angles to the table structure 4 while in use.

A collapsible leg locking bracket 28 is provided between the table structure 4 and each downwardly extending leg section 20. The collapsible leg locking brackets 28 are each identical to one another and include a pair of bracket legs 29,29. The bracket legs are pivotably connected together by a bracket pin 30. Each of the opposite ends of the bracket legs 29,29 are connected by pivotable attachment pins 31 and 34 respectively to the table structure 4 at one end and the upright leg structure 16 at an opposite end. As shown in FIG. 5, the leg locking brackets 28 are collapsible whereby the legs 29,29 move on their pivot points at opposite ends 30, 31, and 34. As shown in FIGS. 5 and 6, the leg locking brackets 28 are collapsible so that the upright leg structure 16 and the table top structure 4 can move together approaching a parallel relationship with respect to each other with the collapsing of the hinge 24.

According to important features of my invention, I have provided a knockdown platform with a new and improved leg and hinge structure combination which co-acts with the tabletop to enable the legs to be independently collapsed relative to one another from an upright position to a collapsed position, as shown in FIGS. 4–7 inclusive. These components are generally configurated and oriented to provide an improved knockdown platform and to eliminate any need for a piano-type hinge shown at 23 in U.S. Pat. No. 5,249,397 where the same hinge is used to collapse both legs. The use of a hinge of this type adds costs to the earlier collapsible roof platform shown in the 397' Patent which can now be avoided. In FIG. 4, the hinge pin 63 enables the leg to be dropped into right angular relation to the tabletop. FIG. 5 shows how the leg structure can be swung into a collapsed position, as shown in FIG. 6.

Now, more specifically, it will be observed from a study of FIG. 6 as well as the other figures that each of my hinge devices 24—24 are include a parallel sided hinge support block 60. Each hinge support block in the preferred embodiment has a flat side 60*a* riveted at 25,25 to fixedly secure the block 60 snugly against an inner flat table top surface 62 of the table top 8 away form the indentations 3 and openings 3*a* (FIG. 1) to avoid interference with the hinge devices 24—24 and the hinge support blocks 60—60 according to still other features of my invention. A hinge pin 63 is provided for each leg to enable the associated leg to pivot or rotate relative to a side flange 64 of the table top 8 and the fixedly mounted hinge support block 60. More specifically, the hinge pin 63 has a length 65 in excess of the length of the hinge support block and the associated leg. One end of the hinge pin 66 is connected by a fastener 67 on an inside vertical surface 68 of the hinge support block 60 and an opposite end of the hinge pin is fastened to an outside vertical surface 69 of the hinge support block. The fastener 67 preferably comprises a cup shaped spring end which can be tapped into fixed assembly with an adjacent end of the hinge pin 63 in a clamped assembly. An opposited capped end 70 of the hinge pin 63 is in fixed assembly. The fastener 60, the hinge pin 63 and the capped end 70 of the hinge pin 63 co-act to rotatably secure the leg 26 in a pocket defined by the flange 64, inner surface 62 and the associated hinge support block 60. This hinged relationship enables the leg to move in an arc as indicated by an arrow in FIG. 5 from an upright position to a collapsed position and vice versa.

While an embodiment of the invention has been illustrated and described, it is understood that this is by way of illustration only and that various changes and modifications may be contemplated within the scope of the following claims.

We claim:

1. A knockdown platform for use on an inclined surface comprising:

a table structure having indented areas for holding tools, a plurality of surfaces forming the table structure, a table top on a first surface of the table structure, a hollowed area on a second surface opposite the first surface on an underside of the table top defining spaced apart corners, extendible multi-sectioned upright legs structures, means for securing legs section in adjusted position relative to one another on each of said extendible multi-sectioned upright leg structures, an upper surface of each of the upright leg structures being fixedly connected to the table top at only one end of the table structure remote from said indented areas but adjacent to said corners, the upper surface of the upright leg structure being positioned in the hollowed area on the underside of the table top and the upright leg structure being positioned in right angular relation to the table structure, a plurality of downwardly extending leg sections extending from the upright leg structure, a pair of hinge mechanisms positioned in spaced apart relation on the hollowed underside of the table structure at the corners connecting the table structure and the upright legs structure in unitary assembly together, and a plurality of collapsible locking bracket mechanisms securing the table structure and the upright leg structures in assembly together, each of said collapsible locking bracket mechanisms being adjustable to secure the table structure and the upright leg structure in right angular relation when in the upright position, the collapsible locking bracket mechanism being releasable to enable the table structure and the upright leg structure to be pivoted on an associated one of the hinge mechanisms into a storage position in the hollowed underside of the table structure where the upright leg structure is in almost parallel relation to the table structure thus enabling movement of the table structure out of right angular relation into a collapsed position.

2. The knockdown platform of claim 1 wherein each of said pair of hinge mechanisms includincluding a hinge block, means fixedly connecting said hinge block to an underside of said tabletop, a rotary mounted hinge pin extended horizontally through said hinge block and an upper end of said leg structure, a capped hinge pin end and a fastener co-acting to secure said leg structure to said table top and to said hinge block for enabling the leg structure to be rotated from an upright to a storage position.

3. The knockdown platform of claim 1 wherein each of the upright leg structures being independently rotatable into said storage position and into a position at right angles to the table top.

4. A knockdown platform for use on an inclined surface comprising:

a table structure, a plurality of surfaces on the table structure, table top on a first surface of the table structure, a hollowed area on a second surface opposite the first surface on an underside of the table top defining spaced apart corners, extendible upright legs structures, means for securing legs section in adjusted position relative to one another on each of said extendible upright leg structures, an upper surface of each of the upright leg structures being fixedly connected to the table top at only one end of the table structure but adjacent to said corners, the upper surface of the upright leg structure being positioned in the hollowed area on the underside of the table top and the upright leg structure being positioned in right angular relation to the table structure, a plurality of downwardly extending leg sections extending from the upright leg structure, a pair of hinge mechanisms positioned in spaced apart relation on the hollowed underside of the table structure at the corners connecting the table structure and the upright legs structure in unitary assembly together, and a plurality of collapsible locking bracket mechanisms securing the table structure and the upright leg structures in assembly together, each of said collapsible locking bracket mechanisms being adjustable to secure the table structure and the upright leg structure in right angular relation when in the upright position, the collapsible locking bracket mechanism being releasable to enable the table structure and the upright leg structure to be pivoted on an associated one of the hinge mechanisms into a storage position in the hollowed underside of the table structure where the upright leg structure is in almost parallel relation to the table structure thus enabling movement of the table structure out of right angular relation into a collapsed position.

5. The knockdown platform of claim 4 wherein said pair of hinge mechanism includes a hinge block, means fixedly connecting said hinge block to an underside of said tabletop, a rotary mounted hinge pin extended horizontally through said hinge block and an upper end of said leg structure, a capped hinge pin end and a fastener co-acting to secure said leg structure to said table top and to said hinge block for enabling the leg structure to be rotated from an upright to a storage position.

6. The knockdown platform of claim 4 wherein each of the upright leg structures are independently rotatable into said storage position and into a position at right angles to the table top.

7. The knockdown platform of claim 4 wherein said pair of hinge mechanism includes a hinge block, means fixedly connecting said hinge block to an underside of said tabletop, a rotary mounted hinge pin extended horizontally through said hinge block and an upper end of said leg structure, means serving said rotary mounted hinge pin to said table top and to said hinge block for enabling the leg structure to be rotated from an upright to a storage position, each of the upright leg structures being independently rotatable into said storage position and into upright position at right angles to the table top ready for use on a roof.

8. A knockdown platform for use on an inclined surface comprising:

a table structure, a plurality of surfaces forming the table structure, an upper table top on a first surface of the table structure, a plurality of openings and indentations in the upper table top, a table top on a first surface of the table structure, a hollowed area on a second surface opposite the first surface on the underside of the table top, an upright leg structure, an upper surface of the upright leg structure, said upper surface connected to the hollowed area on the underside of the table top at only one end of the table structure, an upright position of the upright leg structure having the upper surface of the upright leg structure positioned parallel with the hollowed area on the underside of the table top and the upright leg structure positioned in right angular relation with the table structure, a plurality of downwardly extending leg sections extending from the upright leg structure, a pair of hinge mechanisms each including a hinge block, means fixedly connecting said hinge block to an underside of said tabletop, a rotary mounted hinge pin extended horizontally through said hinge block and an upper end of said leg structure, a capped hinge pin end and a fastener co-acting to secure said leg structure to said table top and to said hinge block for enabling the leg structure to be rotated from an upright to a storage position, and, a plurality of collapsible locking bracket mechanisms securing the table structure and the upright leg structure in assembly together, said collapsible locking bracket mechanism adjustable to secure the table structure and the upright leg structure in right angular relation when in the upright position, said collapsible locking bracket mechanism being collapsible enabling the table structure and the upright leg structure to be pivoted on the hinge into an almost parallel relation to a storage position thus moving and collapsing the table structure.

9. A knockdown platform for use on an inclined surface comprising:

a table structure, a plurality of surface forming the table structure, an upper table top on a first surface of the table structure, a plurality of openings and indentations in the upper table top, a table top on a first surface of the table structure, a hollowed area on a second surface opposite the first surface on the underside of the table top, an upright leg structure, an upper surface of the upright leg structure, said upper surface connected to the hollowed area on the underside of the table top at only one end of the table structure, an upright position of the upright leg structure having the upper surface of the upright leg structure positioned parallel with the hollowed area on the underside of the table top and the upright leg structure positioned in right angular relation with the table structure, a plurality of downwardly extending leg sections extending from the upright leg structure, a hinge mechanism positioned on the hollowed underside of the table structure connecting the table structure and the upright leg structure in assembly together, a plurality of collapsible locking bracket mechanisms securing the table structure and the upright leg structure in assembly together, said collapsible locking bracket mechanism adjustable to secure the table structure and the upright leg structure in right angular relation when in the upright position, said collapsible locking bracket mechanism being collapsible enabling the table structure and the upright leg structure to be pivoted on the hinge into an almost parallel relation to a storage position thus moving and collapsing the table structure, each of the upright leg structures are independently rotatable into said storage position and into a position at right angles to the table top.

* * * * *